United States Patent [19]

Glaesel

[11] 4,047,789

[45] Sept. 13, 1977

[54] ELECTRICAL DISTRIBUTOR BLOCKS

[75] Inventor: Gottfried Glaesel, Minusio, Switzerland

[73] Assignee: Hego Electric GmbH, Glarus, Switzerland

[21] Appl. No.: 660,547

[22] Filed: Feb. 23, 1976

[51] Int. Cl.[2] ..... H01R 9/16

[52] U.S. Cl. ..... 339/198 H; 339/113 B; 339/210 M

[58] Field of Search ..... 339/31, 32, 210, 185, 339/198 R, 198 G, 198 GA, 198 H, 113 B

[56] References Cited

U.S. PATENT DOCUMENTS

| | | | |
|---|---|---|---|
| 2,441,393 | 5/1948 | Buchanan et al. | 339/198 H |
| 2,857,583 | 10/1958 | Markley et al. | 339/113 B |
| 3,245,029 | 4/1966 | Piperato | 339/210 R |
| 3,601,772 | 8/1971 | Mancini | 339/210 M |
| 3,808,584 | 4/1974 | Neff | 339/210 M |
| 3,899,237 | 8/1975 | Briggs, Jr. | 339/198 R |
| 3,905,673 | 9/1975 | Evans et al. | 339/210 M |

FOREIGN PATENT DOCUMENTS

| | | | |
|---|---|---|---|
| 1,134,588 | 12/1956 | France | 339/198 H |
| 1,465,264 | 5/1969 | Germany | 339/31 R |
| 644,540 | 10/1950 | United Kingdom | 339/198 H |

*Primary Examiner*—Roy Lake
*Assistant Examiner*—Neil Abrams
*Attorney, Agent, or Firm*—Pollock, Vande Sande & Priddy

[57] ABSTRACT

An electrical distributor block comprises a narrow body of insulating material having two parallel side faces in each of which is a plurality of U-shaped channels all opening at both ends through the same narrow face of the block and each of L-shaped cross-section for receiving metal terminal pins of differing shapes and dimensions.

9 Claims, 5 Drawing Figures

ELECTRICAL DISTRIBUTOR BLOCKS

The present invention relates to electrical distributor blocks comprising a body or fame of insulating material with connecting pins inserted therein, for establishing wire-wrap and clamp connections or the like to electrical conductors.

Conventional terminal strips comprising a plurality of adjacent terminals, when used to construct a wiring system, occupy an excessive amount of space in control cabinets and call for a very large expenditure in terms of installation. Block-shaped frame members have therefore already been proposed for arrangement side by side on flanged support rails, the tops of such members being provided with a number of terminal pins and the narrow side opposite to the top extending along the terminal pins beyond the top in the manner of a wall with recesses for accommodating incoming and outgoing conductors. The advantage of this is that distributor assemblies can be built up with any desired number of terminal positions. However, disadvantages are that the individual pins cannot be subsequently inserted into or removed from the insulating frame or body, only one size of connecting pin can be used because the pins are not interchangeable, and installation of the assembly in a system can be performed either only vertically or only horizontally, because of the usual narrow rectangular cross-section of the pins, because commercial connecting tools are designed for a horizontal arrangement of the pins in relation to the bottom of an equipment or control cabinet or in relation to the surface on which the operator stands.

It is an object of the present invention to eliminate the previously mentioned disadvantages, and to provide a distributor block that can be used for rapidly building up or altering distributor assemblies of different size, depending on requirements, to permit a high wiring density in the smallest possible space, and to permit the use of terminal pins of different dimensions.

According to the invention we provide an electrical distributor block comprising a body of electrically insulating material having two parallel major side faces and narrow further faces extending between the said major side faces, a plurality of channels in at least one of the major side faces, all the channels being open at both ends through one of the narrow faces, a metal terminal pin being located in at least one side channel and projecting from both ends of the channel, each channel being associated with a rib projecting from the major side face opposite that containing the channel, which rib is disposed so as to project into the corresponding channel of an identical block when placed alongside the first distributor block and thereby to retain a said pin when disposed in the said corresponding channel.

Also according to the invention we provide an electrical distributor assembly comprising a plurality of interlockable frames of insulating material with terminal pins inserted therein for providing wire-wrap and clamp connections or the like, the front and rear side faces of the individual frames of insulating material being provided with a plurality of channels each having two exit apertures on the top of the frame, into which channels the terminal pins can be subsequently inserted, each channel being associated with a retaining rib on the opposite side for retaining the inserted pins in the channels of the adjacent frame.

With this construction it is possible to obtain distributors mounted on assembly rails with a sidely variable number of connecting faces for horizontal and vertical installation within the wiring system, in a particularly simple manner and with only one member of insulating material.

Preferably the top of the individual body or frame is constructed as an inclined plane which drops from the middle towards both ends. This offers the advantage that the conductors extending from the several pins can be guided in more neatly grouped form one beneath the next.

The dimensions of the channels in one face preferably are different from those on the other face so that each insulating body or frame can be provided with a variety of pins. For example, the channels in one face can be designed for the insertion of commercial pins $0.8 \times 2.4$ mm in cross-section and those on the other face can be designed for the insertion of pins $0.8 \times 1.6$ mm in cross-section.

The invention will be further explained by reference to the accompanying drawings, in which.

Figure 1:
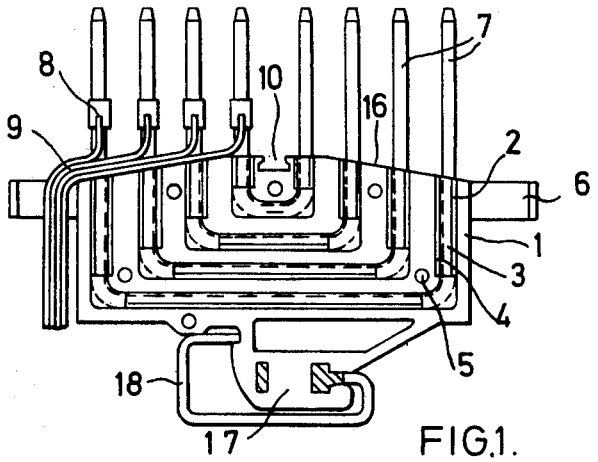
FIG. 1 is a side view of two interlinked distributor blocks.

The distributor block shown in the drawings has a body or frame 1 of insulating material, for example injection-molded plastic. The body is generally slab-shaped, having two parallel major side faces 14, 15 and narrow further faces, of which only the top face 16 is visible, in FIGS. 2–5, extending between the major side faces. The body has a foot 17 shaped so that it can be clipped on to a mounting rail 18 of channel section with inwardly turned flanges, with the major side faces 14, 15 perpendicular to the longitudinal axis of the rail, in known manner. Alternatively, the foot may be shaped to engage a channel-section mounting rail with outwardly turned flanges, or a flat supporting bar, or any other desired kind of mounting.

In practice, a plurality of blocks are mounted face to face, and are interlocked by pins 11 on the face 15 engaging sockets 5 in the face 14.

The face 14 contains a plurality of rectangular U-shaped channels each open at both ends through the top face 16, for receiving terminal pins 7 made from metal sheet or strip. Each pin projects at both ends from its channel as shown in FIG. 1; the pins 7 visible in FIG. 1 are housed in a second block behind that visible in FIG. 1, and accordingly are shown partly in broken lines. They are shown in FIG. 3 but not in FIG. 2.

Each of the aforesaid channels is of L-shaped cross-section. The terminal pins are of flat, preferably rectangular cross-section. Each of the said channels has, in cross-section, a first limb 2 for receiving a terminal pin the major dimension of whose cross-section is perpendicular to the side face 14, the bends in the pin being accordingly centered on axes parallel to the greater cross-sectional dimension of the pin. Such pins can be made for example by stamping and bending a flat strip of metal.

Figures 2, 3:
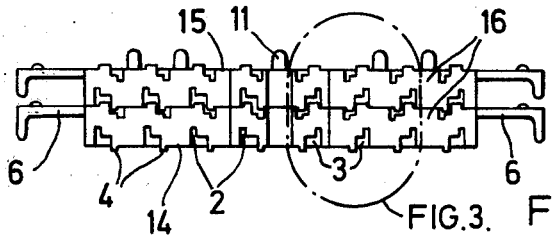
FIG. 2 shows a plan view of the two blocks, without the terminal pins.
FIG. 3 is an enlarged plan view of part of FIG. 2 showing the arrangement of the pins.
Figure 3:
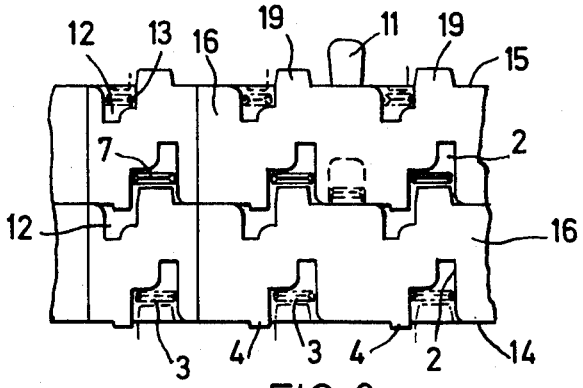

Each of the channels in the face 14 also has a second limb 3 for receiving a pin of which the major cross-sectional dimension is parallel to the face 14, as shown in FIG. 3. The bends of these pins are accordingly centered on axes parallel to the narrow sides of the pin, and the pins are made for example by stamping from flat metal stock using a U-shaped tool.

The side face 15 of the body has projecting ribs 19 in register with the channels 2, 3 and arranged to project part of the way into the channels of an adjacent block, as best shown in FIG. 3, so as to locate the terminal pins 7, of either form, in the channels.

The face 15 also contains L-section channels 12; these are of different dimensions from the channels 2, 3, both in respect of cross-section and of lay-out in the side face of the body, but are also U-shaped and open at both ends through the top face 16. These channels receive terminal pins 13 which, in the example shown, are of smaller cross-section than the pins 7. In register with the channels 12, the other side face 14 has projecting ribs 4 arranged to project part-way into the channels 12 of an adjacent block, to locate and retain the pins 13. On each face, the ribs are immediately adjacent to the channels.

It is to be understood that, in use, it is not essential that every channel should contain a terminal pin; the latter can be provided to suit the requirements of any particular installation. In any event, a distributor assembly of substantially any desired size and arrangement can be built up by means of a plurality of individual blocks mounted side by side, as shown in FIGS. 4 and 5, using only a relatively small number of standard components, namely, the insulating body, and pins to fit each channel, which in the case illustrated requires only 16 different types of pin.

Figure 4:
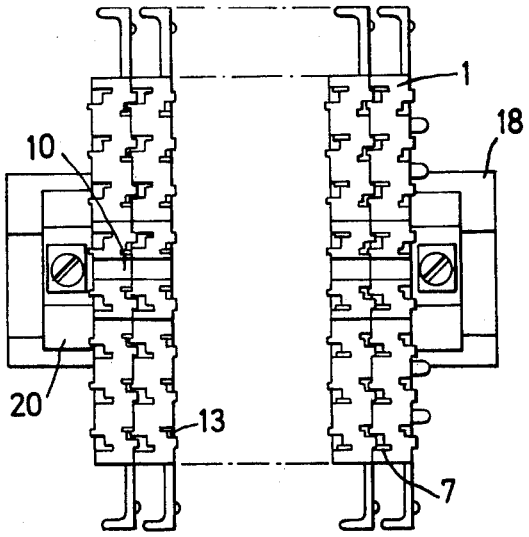
FIG. 4 is a plan view showing the arrangement of a plurality of individual blocks on a horizontally mounted rail, with terminal pins which lie in horizontal planes.
Figure 5:
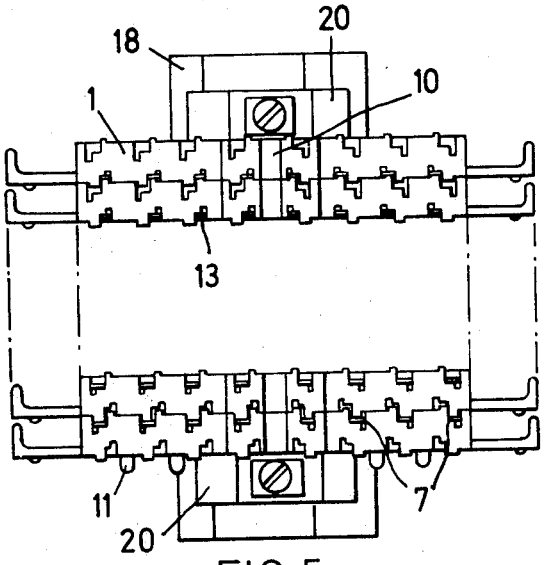
FIG. 5 is a plan view of a similar arrangement to FIG. 4 on a vertical rail with terminal pins lying in horizontal planes.

As shown in FIGS. 4 and 5, the mounting rail 18 can extend horizontally or vertically, and in either case the projecting part of the pins 7, 13 can be arranged to lie in horizontal planes, this being the arrangement for which most conventional wiring tools are designed.

FIGS. 4 and 5 also show end clamps 20 clamped to the mounting rail, to hold the distributor blocks firmly in place so that they cannot be accidentally dislodged.

Individual conductors 9 are connected to respective pins 7 for example by clamps 8. Preferably, the top face 16 of the body forms a double inclined plane, sloping down in both directions from a central region which contains a recess 10 for receiving an identifying tab or plate. The sloping arrangement of the top face enables the conductors to be laid one on another as shown in FIG. 1, providing a neat arrangement and avoiding crowding of the conductors under the outermost clamp 8. The body is also provided with L-shaped guides 6 for the conductors 9.

I claim:

1. An electrical distributor block comprising a. a body of electrically insulating material having two parallel major side faces and narrow further faces extending between the said major side faces;

b. a plurality of generally U-shaped channels in at least one of the major side faces, all the channels being open at both ends through a single one of the narrow faces, at least one said channel being of L-shaped cross-section transverse to its length for receiving selectively a said pin disposed with its greatest cross-sectional dimension either perpendicular or parallel to the major side faces;

c. a generally U-shaped metal terminal pin located in at least one said channel and projecting from both ends thereof;

d. a rib associated with each channel provided on and projecting from the major side face of the body opposite that containing the channel, said rib corresponding in shape and position to and of no greater lateral dimensions that the associated channel, whereby when two identical blocks are placed side by side the ribs of a first said block will enter the channels of the adjacent block thereby to retain said pin in said channel.

2. A distributor block according to claim 1, wherein at least one said pin is formed from sheet or strip metal stock whereby the pin cross-section is elongate.

3. A distributor block according to claim 2, wherein at least one said pin is disposed with its greatest cross-sectional dimension parallel to the major side faces.

4. A distributor block according to claim 2, wherein at least one said pin is disposed with its greatest cross-sectional dimension perpendicular to the major side faces.

5. A distributor block as claimed in claim 1, wherein each major side face is provided with said channels and ribs.

6. A distributor block as claimed in claim 5, wherein the channels and ribs on one side face are of different cross-sections from the channels and ribs of the other side face.

7. A distributor block according to claim 1, wherein at least one guide for conductors to be connected to the pins is provided on at least one end face of the block.

8. A distributor block according to claim 1, wherein the said one of the narrow faces is constructed as an inclined plane which drops from the middle towards the ends, and a recess for identification plates is provided in the middle of the top.

9. A distributor block according to claim 1, wherein the block is provided with means for mounting transversely on a support rail and with matching detent noses and holes for interlocking with one or more adjacent blocks.

* * * * *